US010544691B2

(12) United States Patent
Houck et al.

(10) Patent No.: US 10,544,691 B2
(45) Date of Patent: Jan. 28, 2020

(54) STAKING TOOL ASSEMBLY

(71) Applicant: Solar Turbines Incorporated, San Diego, CA (US)

(72) Inventors: James Neal Houck, Encinitas, CA (US); Jewell Winifred Willmon, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 204 days.

(21) Appl. No.: 15/861,828

(22) Filed: Jan. 4, 2018

(65) Prior Publication Data

US 2019/0203604 A1 Jul. 4, 2019

(51) Int. Cl.

| | |
|---|---|
| ***F01D 5/32*** | (2006.01) |
| ***F01D 5/02*** | (2006.01) |
| ***F01D 5/12*** | (2006.01) |
| ***B25B 27/02*** | (2006.01) |
| ***B25B 31/00*** | (2006.01) |

(52) U.S. Cl.

CPC ..... *F01D 5/326* (2013.01); *B25B 27/02* (2013.01); *B25B 31/00* (2013.01); *F01D 5/02* (2013.01); *F01D 5/12* (2013.01); *F05D 2230/64* (2013.01)

(58) Field of Classification Search

CPC ..... B25B 27/00; B25B 27/02; B25B 31/00; F01D 5/30; F01D 5/3053; F01D 5/326; B21J 15/10; B21J 15/105; B21J 15/041; B23Q 3/063

See application file for complete search history.

(56) References Cited

U.S. PATENT DOCUMENTS

| | | | | |
|---|---|---|---|---|
| 2,485,954 A * | 10/1949 | Ellis | F16B 39/02 29/243.5 |
| 2,881,646 A * | 4/1959 | Farr | B25B 27/00 29/243.5 |
| 2,944,326 A * | 7/1960 | Stadthaus | B21K 25/00 29/889.22 |
| 3,088,708 A * | 5/1963 | Feinberg | F01D 5/3038 416/215 |
| 4,400,137 A * | 8/1983 | Miller | F01D 5/326 29/889.1 |
| 4,451,959 A * | 6/1984 | Miller | F01D 5/326 29/426.4 |
| 4,767,247 A * | 8/1988 | Partington | F01D 5/22 416/193 A |
| 7,600,407 B2 * | 10/2009 | Nguyen | B21D 28/34 29/512 |

(Continued)

FOREIGN PATENT DOCUMENTS

FR 2964584 8/2013

*Primary Examiner* — Tyrone V Hall, Jr.
(74) *Attorney, Agent, or Firm* — James R. Smith

(57) ABSTRACT

A staking tool assembly for staking a pin coupling a turbine blade with a turbine disk is disclosed. The staking tool assembly includes a guide block configured to be positioned between a space defined between two consecutive turbine blades mounted on the turbine disk. The guide block includes a bottom surface configured to abut a blade root of the turbine blade. The guide block further includes a groove extending from the bottom surface through the guide block. The groove is configured to receive a portion of the pin extending outwardly from the blade root to facilitate a staking of the pin.

14 Claims, 14 Drawing Sheets

(56) References Cited

U.S. PATENT DOCUMENTS

| | | | | |
|---|---|---|---|---|
| 8,277,186 | B2 * | 10/2012 | Tanaka | F01D 5/225<br>415/220 |
| 9,289,860 | B2 * | 3/2016 | Ubukata | B23Q 3/063 |
| 9,689,268 | B2 * | 6/2017 | Deallenbach | F01D 5/225 |
| 10,047,615 | B2 * | 8/2018 | Hofsommer | B23P 19/02 |
| 2012/0099999 | A1 * | 4/2012 | Bhokardole | F01D 5/3007<br>416/219 R |
| 2012/0168601 | A1 * | 7/2012 | Cant | F01D 5/3053<br>248/672 |
| 2013/0333173 | A1 * | 12/2013 | Nishioka | B25B 27/30<br>29/23.51 |
| 2014/0245752 | A1 * | 9/2014 | Kurapati | F01D 5/14<br>60/805 |
| 2014/0286782 | A1 * | 9/2014 | Mulford | F01D 5/32<br>416/220 R |

* cited by examiner

STAKING TOOL ASSEMBLY

TECHNICAL FIELD

The present disclosure relates generally to a staking tool assembly and, more particularly, to a staking tool assembly for staking a pin coupling a turbine blade with a turbine disk.

BACKGROUND

Gas turbine engines (GTEs) produce power by extracting energy from a flow of hot gas produced by combustion of fuel in a stream of compressed air. In general, turbine engines have an upstream air compressor coupled to a downstream turbine with a combustion chamber ("combustor") in between. Energy is released when a mixture of compressed air and fuel is burned in the combustor. The resulting hot gases are directed over blades of the turbine to spin the turbine and produce mechanical power.

Turbine blades and other components of GTEs are subject to high temperatures and high local stresses during operation. Due to rotation of a turbine rotor disk supporting the turbine blades, the turbine blades experience a centrifugal force, and therefore must be retained within the rotor disk. While a turbine blade root, for example a dovetail, can facilitate retention of the turbine blade, additional means to retain the turbine blade can be employed.

For example, retaining pins may be utilized for coupling turbine blades within the turbine rotor disk and preventing axial movement of the turbine blades relative to the turbine rotor disk. The retaining pins are staked in place to prevent dislodging of the pin during a turbine rotation. Generally, to perform staking of the retaining pins, a punch may be positioned above the retaining pins and held in place manually. Thereafter, a hammer may be used to strike the punch to stake the pin. However, as the punch is held in position manually, the punch may move away from the pin during staking and may hit and damage the turbine blade, which is undesirable.

SUMMARY OF THE DISCLOSURE

In one aspect of the present disclosure, a taking tool assembly for staking a pin coupling a turbine blade with a turbine disk is disclosed. The staking tool assembly includes a guide block configured to be positioned between a space defined between two consecutive turbine blades mounted on the turbine disk. The guide block includes a bottom surface configured to abut a blade root of the turbine blade. The guide block further includes a groove extending from the bottom surface through the guide block. The groove is configured to receive a portion of the pin extending outwardly from the blade root to facilitate a staking of the pin.

DETAILED DESCRIPTION

Figure 1:
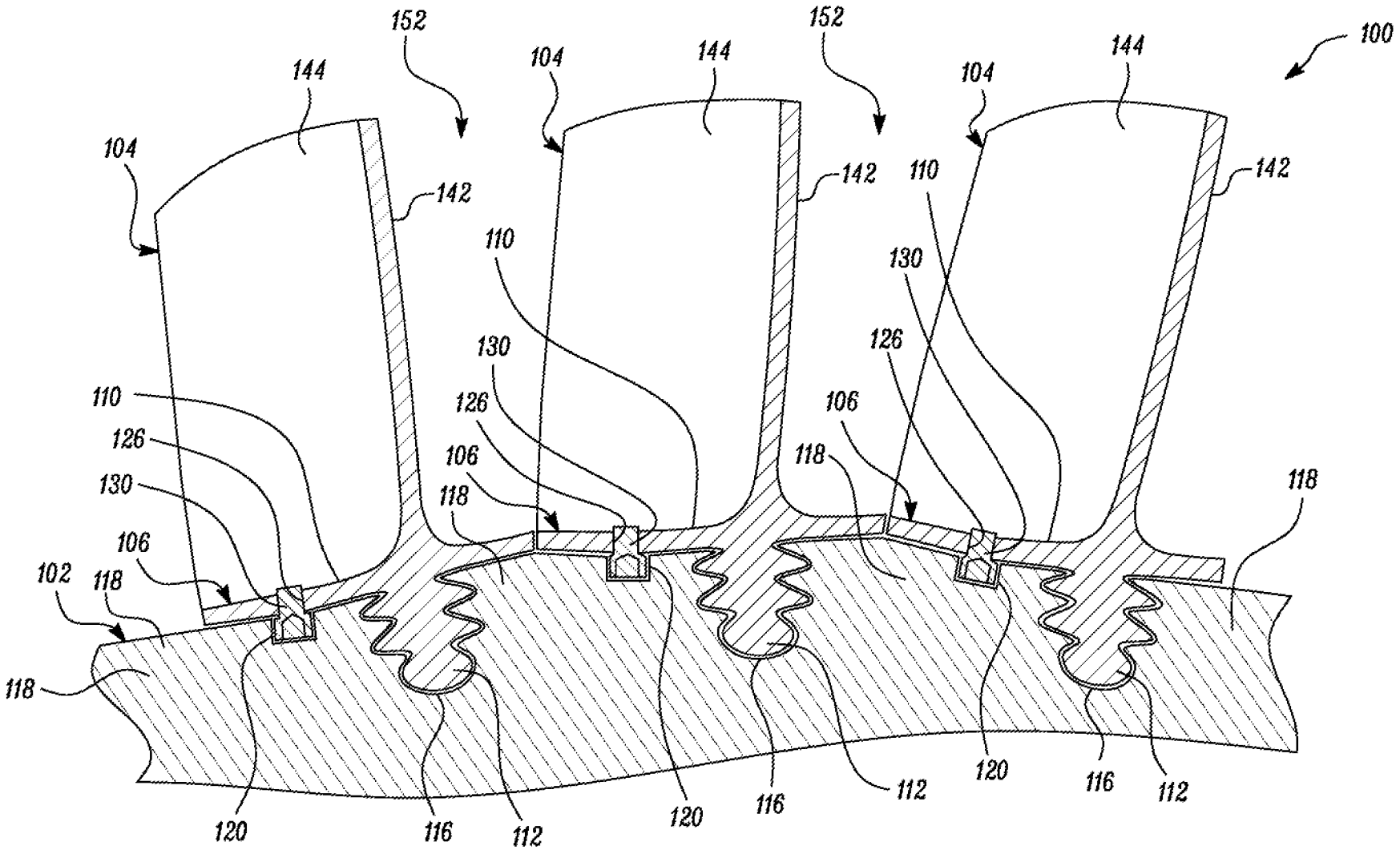
FIG. 1 is a cross-sectional view of a turbine depicting turbine blades coupled to a turbine disk, and pins coupling the turbine blades with the turbine disk, in accordance with an embodiment of the present disclosure.

FIG. 1 is a cross-sectional view of a portion of a turbine 100 for example a gas turbine. The turbine 100 includes a turbine disk 102, and a plurality of turbine blades 104 mounted on the turbine disk 102. Each turbine blade 104 includes a blade root 106 having a platform 110 and a root structure 112 to be received in a correspondingly shaped cutout 116 in the turbine disk 102. As shown in FIG. 1, the root structure 112 may be configured as a dovetail. Although, the root structure 112 may be contemplated as the dovetail, other shapes of the root structure 112 and corresponding cutout 116 can be provided for each turbine blade 104 and the turbine disk 102, respectively. Each root structure 112 is received and supported between turbine disk posts 118 of the turbine disk 102. It should be noted that FIG. 1 shows clearances between the turbine disk 102 and the root structures 112 and platforms 110 for illustration purposes only. While these clearances may exist in the turbine 100, the turbine disk 102 may be in direct contact with one or more surfaces of the root structure 112 and/or platform 110 of one or more of the turbine blades 104. The turbine disk 102 includes one or more slots 120 that may be formed in each turbine disk post 118. The slots 120 are arrayed circumferentially around an outer diameter of the turbine disk 102. In an embodiment, the slots 120 may be arranged in an axial direction (i.e. parallel to a turbine axis) and a flow of gas in the flow path).

As shown in FIG. 1, each turbine blade 104 includes a hole 126 extending through the platform 110. The hole 126 may be configured to be aligned with the slot 120 such that the hole 126 and the slot 120 may receive a pin 130. The pin 130 may be installed through the hole 126 and into the slot 120. The pin 130 may also be referred to herein as either a staking pin, a locking pin, a retaining pin, or the like. The pin 130 may be installed through the hole 126 and into the slot 120 so as to secure or couple the turbine blade 104 to the turbine disk 102. In an installed state, a portion of the pin 130 disposed in the slot 120 exhibits what can be referred to as a flared or mushroom shape. That is, the portion of the pin 130 in the slot 120 extends beyond the edges of the hole 126 under part of the platform 110. Although FIG. 1 shows the portion of the pin 130 disposed in the slot 120 being flared or mushroomed in a substantially uniform manner, this may not always be the case. For example, the portion of the pin 130 disposed in the slot 120 may deform in a non-uniform manner, such that parts of a wall of a hollow cylindrical portion are deformed more or less than other parts of the wall. In some instances, the portion of the pin 130 disposed in the slot 120 may have a width substantially equal to a width of the slot 120, which may be greater than a width of a portion of the pin 130 extending through the hole 126 of the platform 110. Although not illustrated in FIG. 1, in the installed state, the pin 130 may abut the sides of the slot 120 defining the width, such that the pin 130 substantially spans the distance between the sides of the slot 120. Flaring or deformation or staking of the pin 130 is achieved by using a staking tool assembly 150 as described in more detail below.

Figure 2:
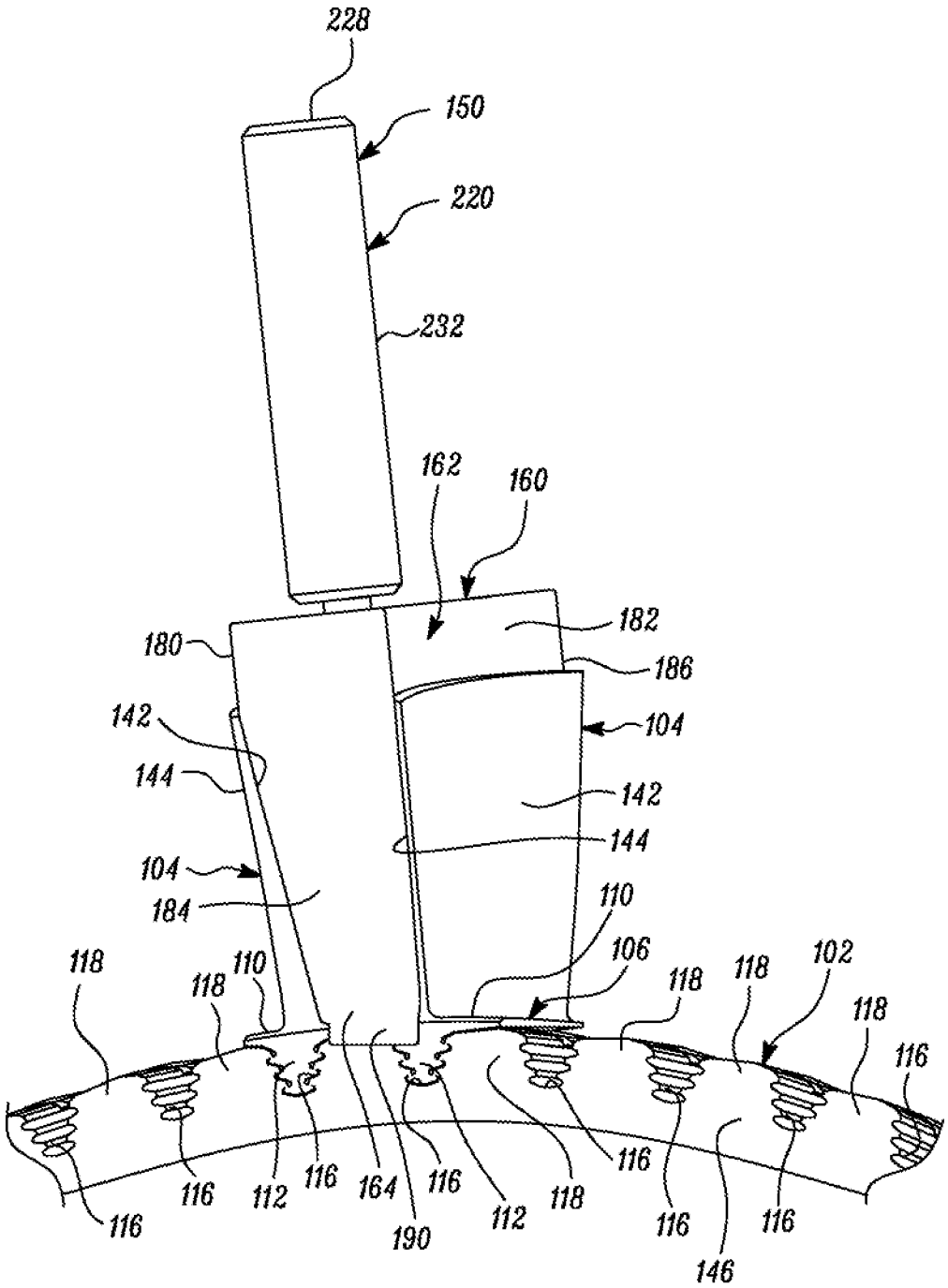
FIG. 2 is a perspective view of a staking tool assembly having a guide block disposed between a space defined between two consecutive turbine blades, in accordance with an embodiment of the present disclosure.
Figure 3:
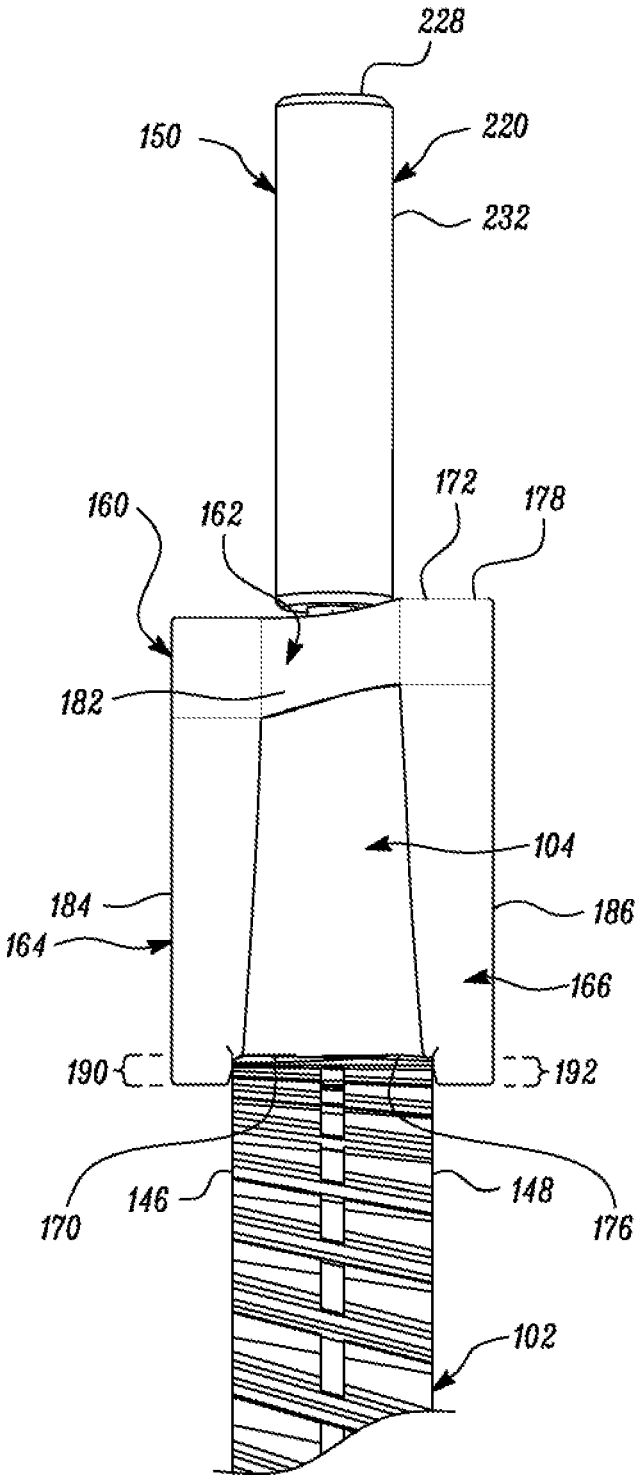
FIG. 3 is a side view the staking tool assembly having the guide block disposed between the space defined between two consecutive turbine blades, in accordance with an embodiment of the present disclosure.
Figure 4:
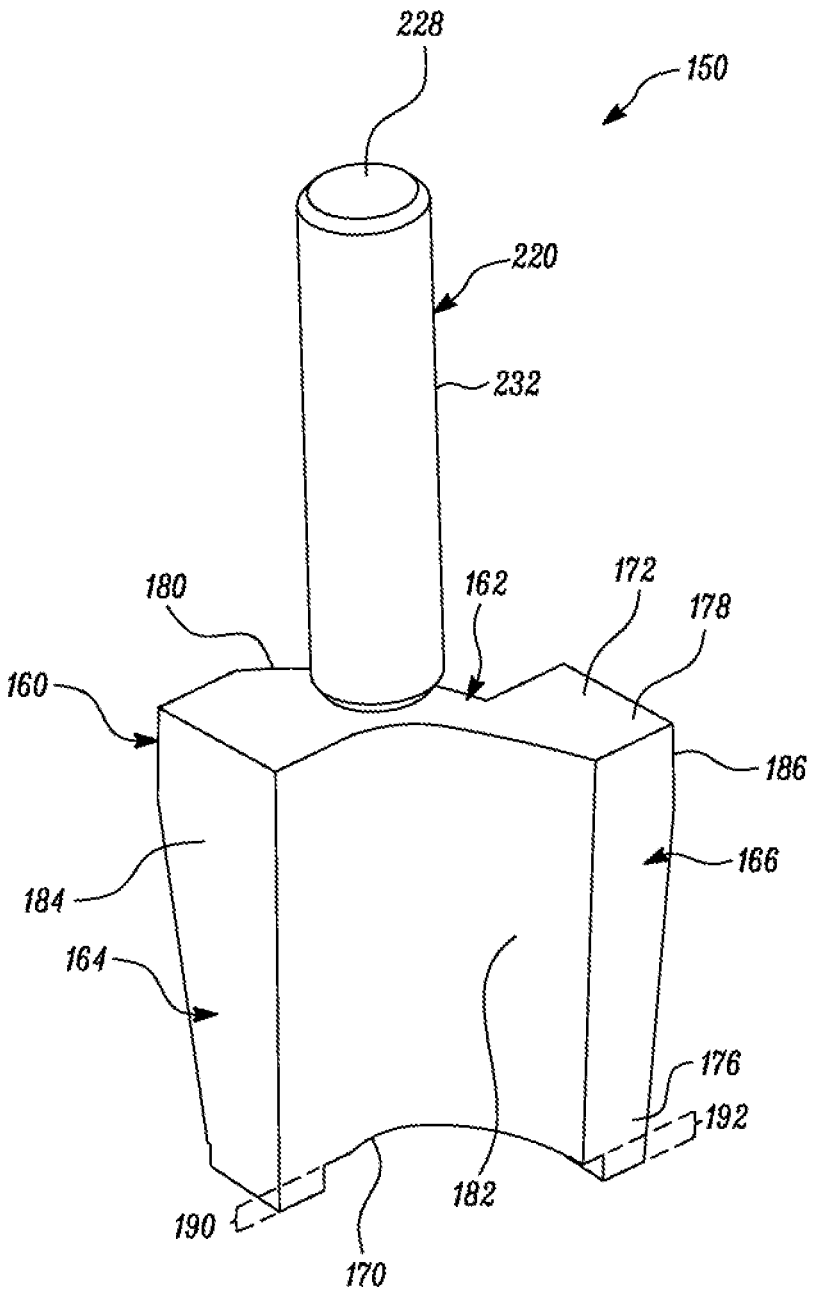
FIG. 4 is a perspective view of the staking tool assembly depicting a punch inserted inside the guide block, in accordance with an embodiment of the present disclosure.
Figure 5:
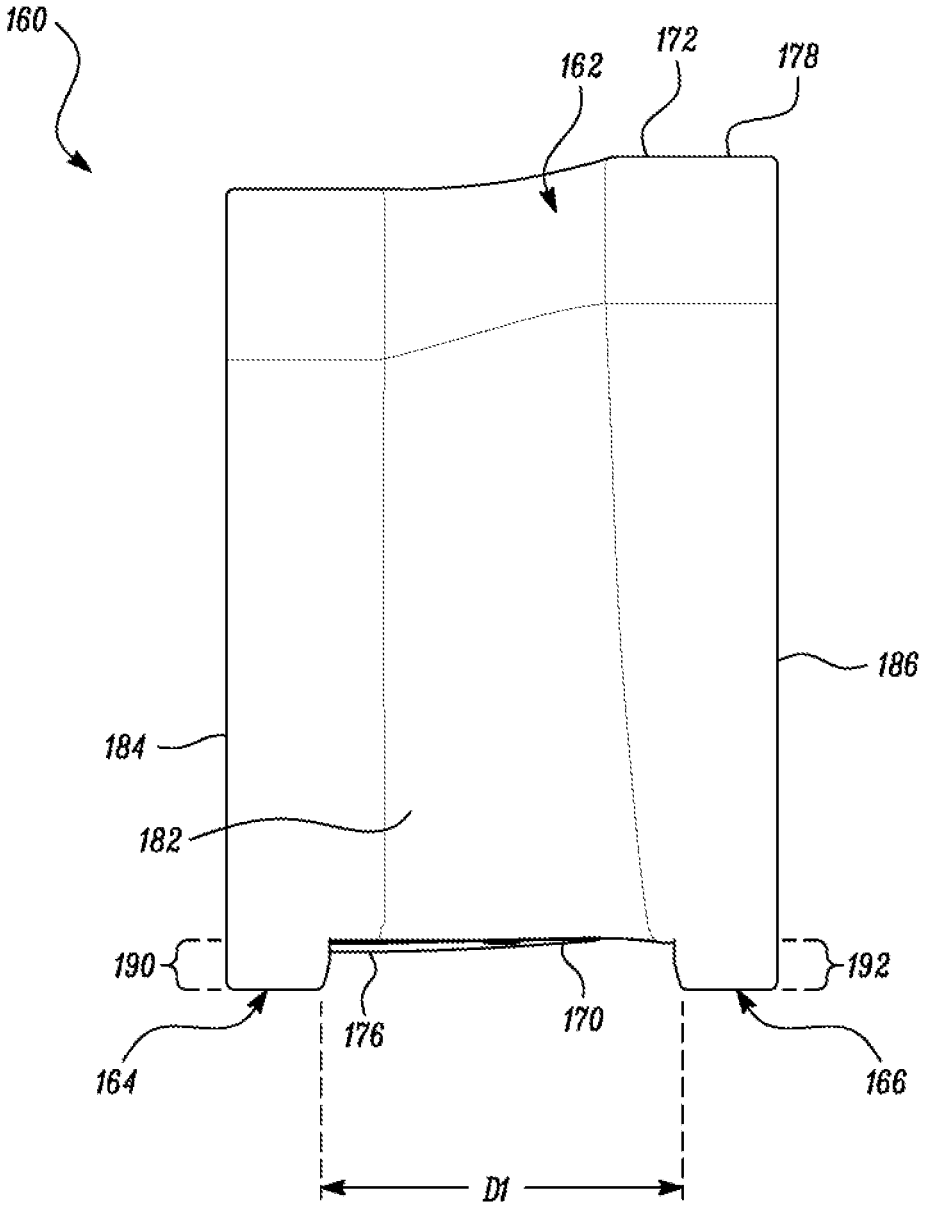
FIG. 5 is a side view of the guide block of the staking tool assembly of FIG. 4 depicting a second longitudinal surface of the guide block, in accordance with an embodiment of the present disclosure.
Figure 6:
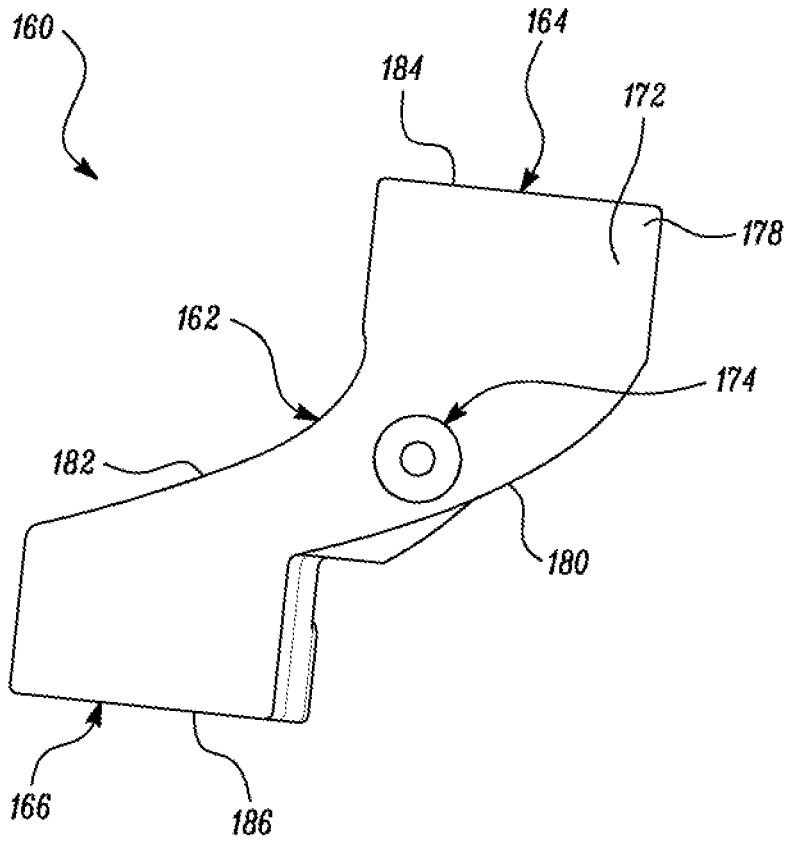
FIG. 6 is top view of the guide block of FIG. 4 depicting a groove extending from a top surface of the guide block, in accordance with an embodiment of the present disclosure.

Referring to FIG. 2 and FIG. 3, the staking tool assembly 150, disposed between a space 152 (shown in FIG. 1) defined between two adjacent turbine blades 104, is shown. The staking tool assembly 150 includes a guide block 160 configured to be disposed between the space 152 defined between two consecutive turbine blades 104 mounted on the turbine disk 102 for facilitating the staking of the pin 130.

Referring to FIG. 2 to 7, the guide block 160 may be a solid unitary body, and may include a body portion 162, a first leg portion 164, a second leg portion 166, a bottom surface 170, a top surface 172, a groove 174, a first axial end 176, and a second axial end 178. The bottom surface 170 is configured to abut the platform 110 of the turbine blade 104, and is disposed at the first axial end 176 of the guide block 160. The top surface 172 is disposed opposite to the bottom surface 170, and is disposed at the second axial end 178 of the guide block 160. The body portion 162 may include a first longitudinal surface 180, and a second longitudinal surface 182 disposed opposite to the first longitudinal surface 180. Each of the first longitudinal surface 180 and the second longitudinal surface 182 may be disposed between the first axial end 176 and the second axial end 178. Further, each of the first longitudinal surface 180 and the second longitudinal surface 182 is disposed between the top surface 172 and the bottom surface 170. In certain implementations, as shown in FIGS. 2 and 3, in an installed state, the first longitudinal surface 180 may abut a pressure side 142 of the turbine blade 104, while the second longitudinal surface 182 may abut a suction side 144 of a consecutively arranged turbine blade 104. To enable such abutments, the first longitudinal surface 180 may include a first profile complimentary to the pressure side 142 of the turbine blade 104, while the second longitudinal surface 182 may include a second profile complementary to the suction side 144 of the turbine blade 104.

The first leg portion 164 may be disposed at a first longitudinal end 184 of the guide block 160, while the second leg portion 166 may be disposed at a second longitudinal end 186 of the guide block 160. Although not limited, the first leg portion 164 may extend from the first axial end 176 to the second axial end 178, and similarly, the second leg portion 166 may extend from the first axial end 176 to the second axial end 178. Moreover, the body portion 162 may extend between the first leg portion 164 and the second leg portion 166. The first leg portion 164 may include a first extended portion 190 formed at the first axial end 176, while the second leg portion 166 may include a second extended portion 192 formed at the first axial end 176. Each of the first extended portion 190 and the second extended portion 192 may extend beyond the bottom surface 170, and may be spaced apart from each other by a distance. DI (shown in FIG. 5). The distance DI may be selected so that, in an installed state of the guide block 160, the first extended portion 190 of the first leg portion 164 may abut a first axial end 146 of the turbine disk 102 (shown in FIG. 3), while the second extended portion 192 of the second leg portion 166 may abut a second axial end 148 (opposed to the first axial end 146) of the turbine disk 102 (shown in FIG. 3). Such abutment of the first extended portion 190 and the second extended portion 192 may facilitate an alignment of the hole 126 with the groove 174.

Figure 7:
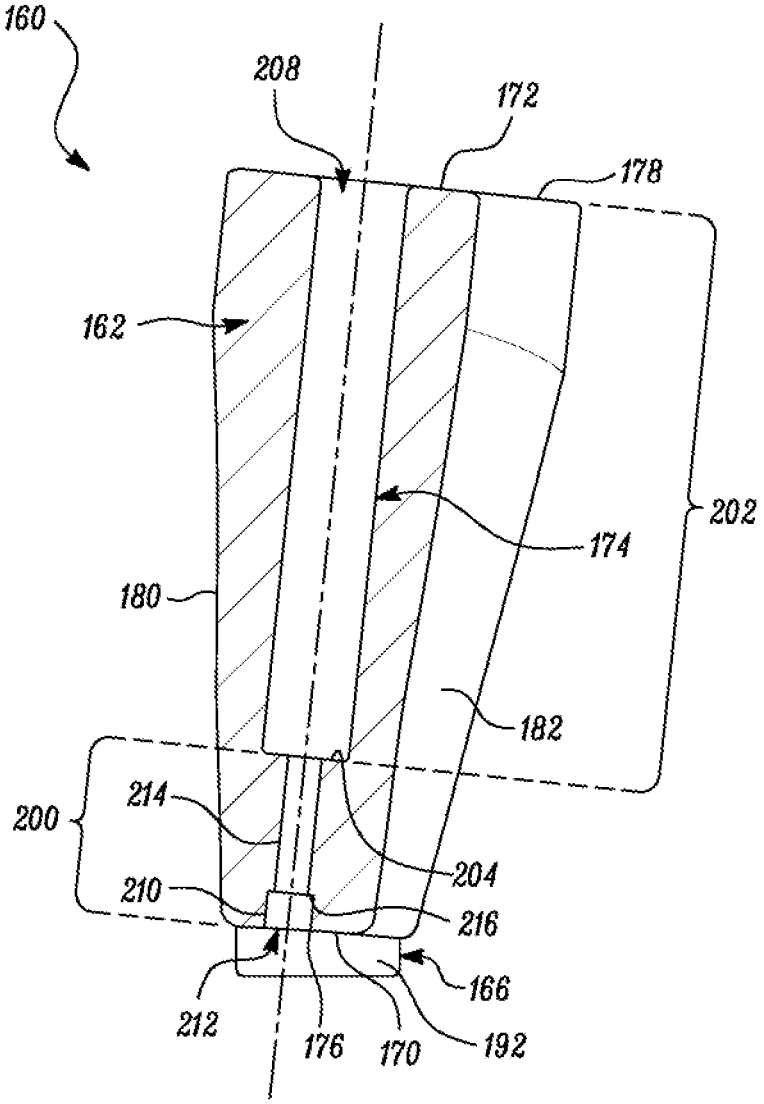
FIG. 7 is a sectional front view of the guide block of FIG. 4 depicting the groove having a first portion and a second portion, in accordance with an embodiment of the present disclosure.

As shown in FIG. 7, the groove 174 extends from the bottom surface 170, and is configured to receive a portion of the pin 130 extending outwardly from the blade root 106 to facilitate the staking of the pin 130. As shown in FIG. 7, the groove 174 extends from the bottom surface 170 through the body portion 162 to the top surface 172. The groove 174 includes a first portion 200 and a second portion 202. The first portion 200 extends from the bottom surface 170 into the body portion 162 towards the top surface 172, and is configured to receive the portion of the pin 130. The second portion 202 extends from the first portion 200 away from the bottom surface 170, and defines a step 204 at an interface of the first portion 200 with the second portion 202. As shown, the second portion 202 extends from the first portion 200 to the top surface 172, and defines an opening 208 at the top surface 172.

Further, the first portion 200 includes a lower portion 210 that extends from the bottom surface 170 into the body portion 162, and is configured to receive the portion of the pin 130. The lower portion 210 defines an opening 212 at the bottom surface 170 to facilitates an entry of the pin 130 into the groove 174. The first portion 200 also includes an upper portion 214 that extends from the lower portion 210 away from the bottom surface 170 to the second portion 202. In an embodiment, both the upper portion 214 and the lower portion 210 include cylindrical profiles, and includes a first diameter and a second diameter respectively. The diameter of the upper portion 214 i.e., the first diameter is smaller than the diameter of the lower portion 210 i.e., the second diameter. Owing to a smaller diameter of the upper portion 214 relative to the diameter of the lower portion 210, a step 216 is defined at an interface of the lower portion 210 with the upper portion 214. The step 216 is configured to restrict a movement of the pin 130 into the upper portion 214 of the groove 174.

Further, in an embodiment, the second portion 202 of the groove 174 may also include a cylindrical profile having a third diameter. As shown, a diameter of the second portion 202 i.e., the third diameter is larger than the diameter of the upper portion 214 i.e., the first diameter and the diameter of the lower portion 210 i.e., the second diameter. In an embodiment, each of the lower portion 210, the upper portion 214, and the second portion 202 define a constant cross-sectional area throughout corresponding extensions. The step 204 is defined/formed at the interface of the second portion 202 with the upper portion 214 of the first portion 200 due to a relatively larger diameter of the second portion 202 relative to the diameter of the upper portion 214 of the first portion 200. The second portion 202, the upper portion 214, and the lower portion 210 may be co-axial to each other. Further, the opening 208 defined at the top surface 172 of the guide block 160 facilitate an entry of a punch into the groove 174 of the staking tool assembly 150 for facilitating the staking of the pin 130.

Figure 8:
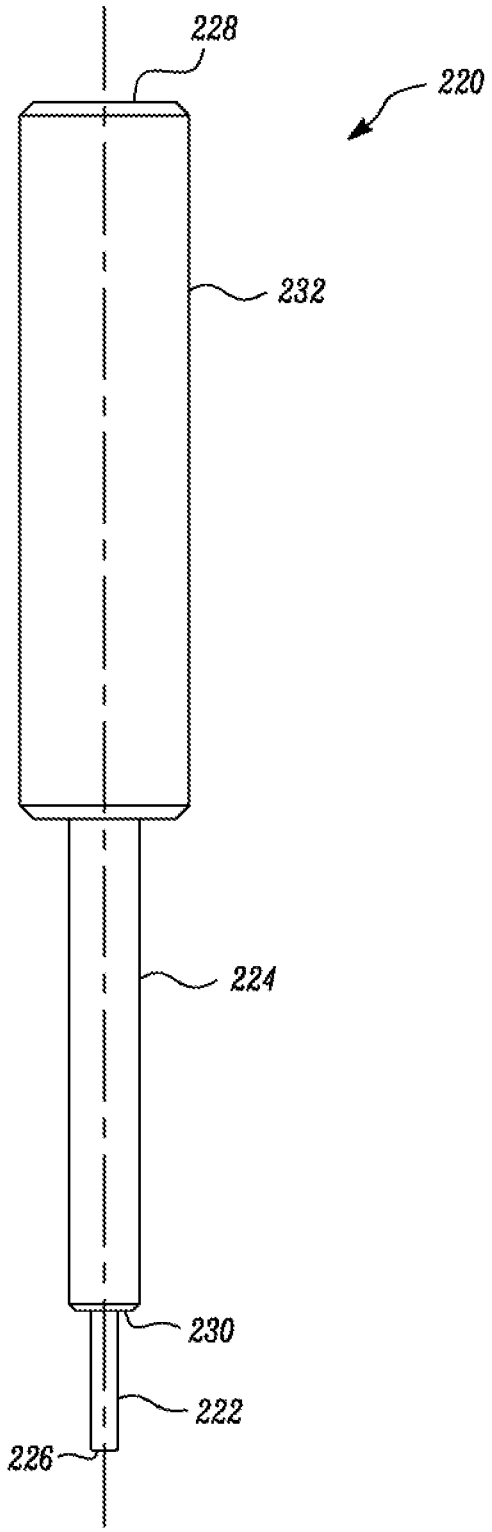
FIG. 8 is a front view of the punch of FIG. 4, in accordance with an embodiment of the present disclosure.
Figure 9:
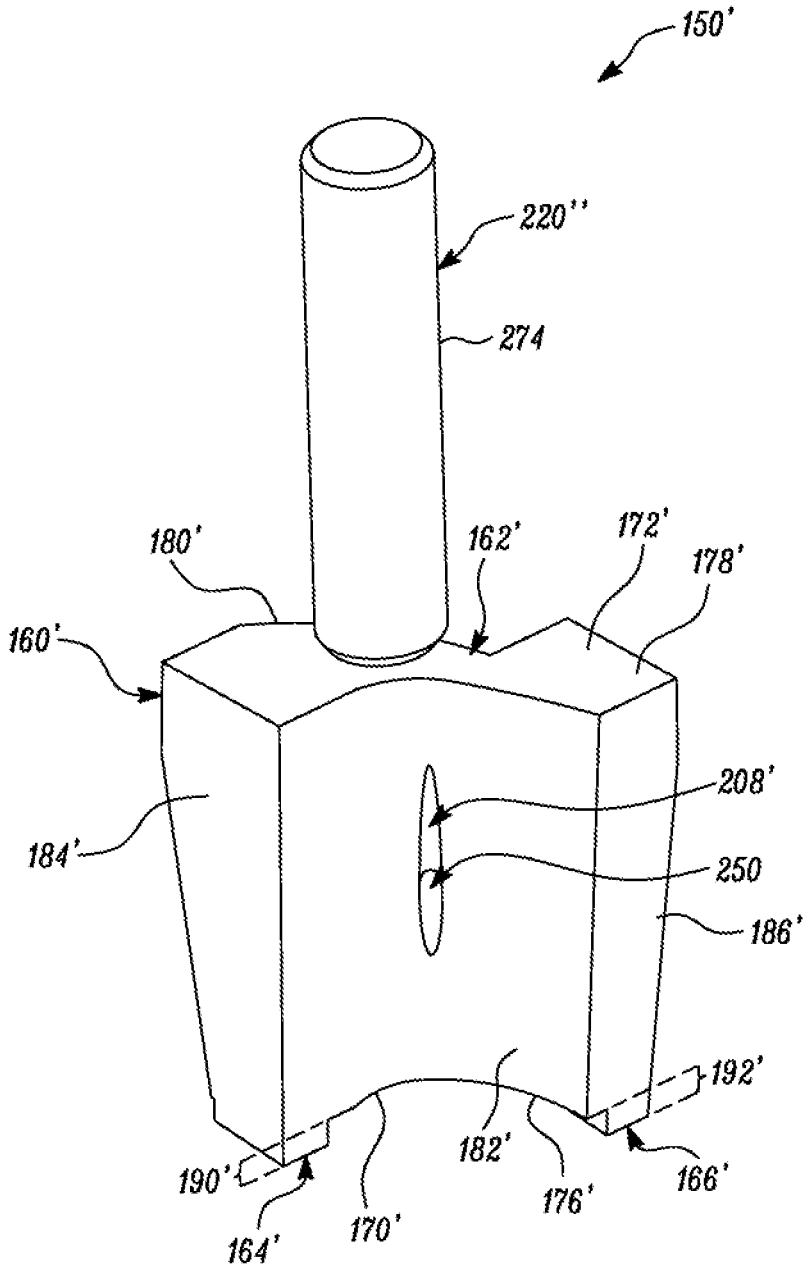
FIG. 9 is a perspective view of a staking tool assembly depicting a guide block and a second punch inserted inside the guide block, in accordance with an alternate embodiment of the present disclosure.
Figure 10:
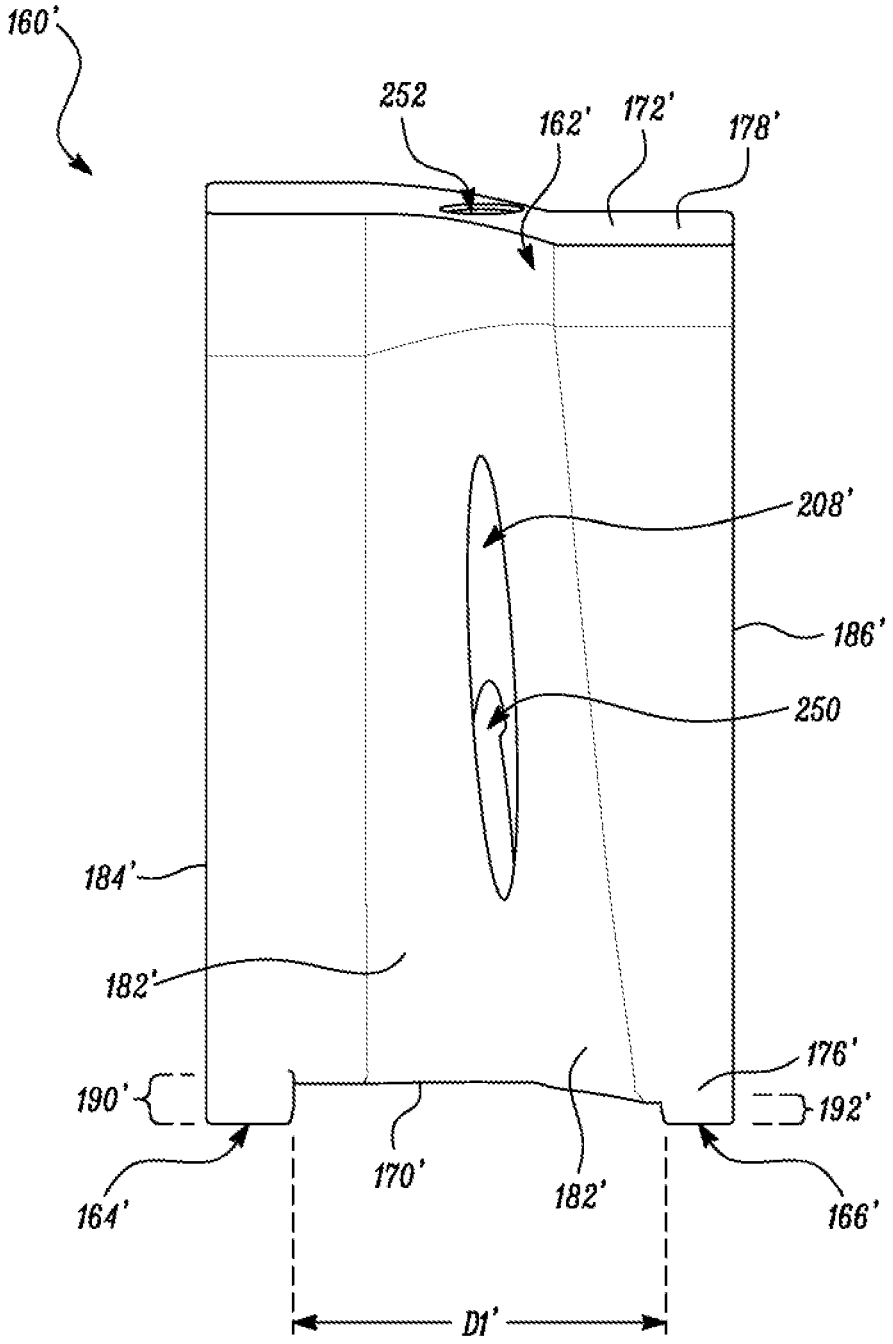
FIG. 10 is a side view of the guide block of the staking tool assembly of FIG. 9 depicting a first groove extending from a second longitudinal surface of the guide block, in accordance with an embodiment of the present disclosure.
Figure 11:
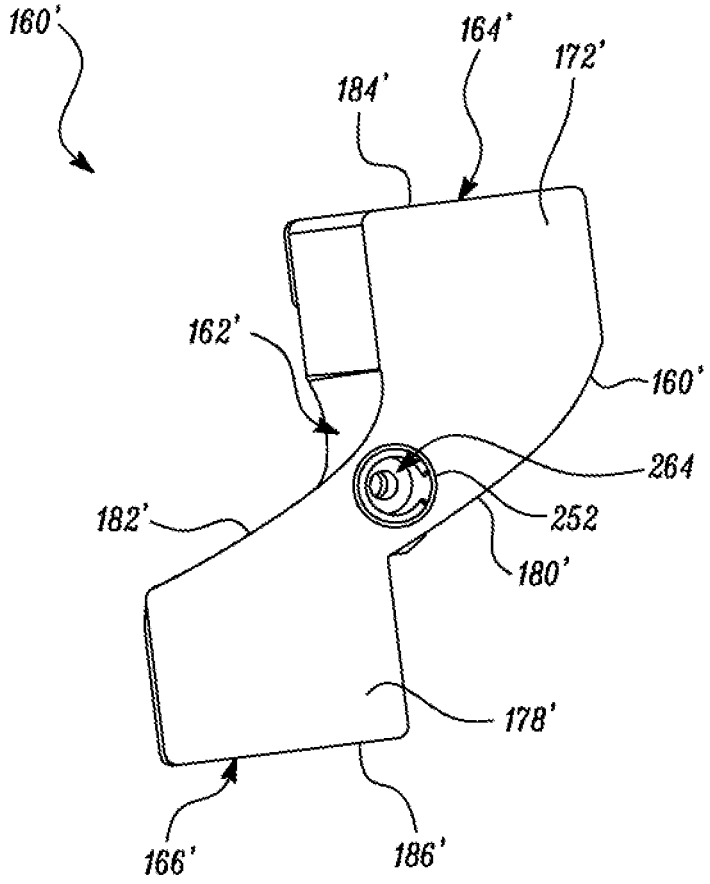
FIG. 11 is top view of the guide block of FIG. 9 depicting a second groove extending from a top surface of the guide block, in accordance with an embodiment of the present disclosure.

The staking tool assembly 150 further includes a punch 220 that may be inserted and extended into the groove 174 to perform the staking of the pin 130. Referring to FIG. 8, the punch 220 may include a first shank portion 222, a second shank portion 224, a first end 226, and a second end 228. The first shank portion 222 extends from the first end 226 to the second shank portion 224. A profile of the first shank portion 222 may be complementary to a profile of the upper portion 214 of the first portion 200 of the groove 174. In an embodiment, the first shank portion 222 may include a cylindrical profile, and may include a first diameter. The first shank portion 222 is configured to be slidably received within the first portion 200 of the groove 174 to facilitate the staking of the pin 130. Further, in an embodiment, a diameter of the first shank portion 222 i.e., the first diameter may be such that an outer surface of the first shank portion 222 may abut an inner surface of the upper portion 214 of the first portion 200 of the groove 174.

In an embodiment, a length of the first shank portion 222 may be equal to a height of the first portion 200 of the groove 174. This prevents a movement of the punch 220 beyond the bottom surface 170 during the staking of the pin 130. Further, the length of the first shank portion 222 may be greater than a height defined by the upper portion 214 of the first portion 200 of the groove 174. This enables the first shank portion 222 to move beyond the upper portion 214 along a direction of insertion of the punch 220, and to extend at least partly into the lower portion 210 of the first portion 200 of the groove 174. Such movement and extension facilitate the first shank portion 222 to abut and strike the pin 130 received into the lower portion 210 of the first portion 200 of the groove 174 for performing staking of the pin 130. The movement and the extension of the first shank portion 222 into the lower portion 210 of the first portion 200 of the groove 174 may be restricted by the step 204.

The second shank portion 224 extends longitudinally away from the first shank portion 222 towards the second end 228, and a profile of the second shank portion 224 may be complementary to a profile of the second portion 202 of the groove 174. In this manner, the second shank portion 224 may be configured to abut the step 204 to restrict a movement of the punch 220 towards the bottom surface 170. To this end, the second shank portion 224 defines a stopper 230 at an interface of the second shank portion 224 with the first shank portion 222. The stopper 230 abuts the step 204 to restrict an axial movement of the punch 220 within the groove 174 towards the bottom surface 170. In an embodiment, the second shank portion 224 may include a cylindrical profile having a second diameter. In an embodiment, the diameter of the second shank portion 224 i.e., the second diameter is larger than the diameter of the first shank portion 222 i.e., the first diameter. In such a case, the stopper 230 is defined/formed at the interface of the second shank portion 224 with the first shank portion 222 due to a relatively larger diameter of the second shank portion 224 relative to the diameter of the first shank portion 222.

In an embodiment, as illustrated, the punch 220 may include a handle 232 extending longitudinally from the second shank portion 224 away from the first shank portion 222 to the second end 228. The handle 232 is configured to extend outwardly to the groove 174 to be held by an operator to perform staking of the pin 130. In an embodiment, the handle 232 is configured to abut the top surface 172 of the guide block 160 to restrict a movement of the punch 220 towards the bottom surface 170 within the groove 174. In certain implementations, the handle 232 may include a cylindrical profile, and may include a diameter larger than the diameter of the second shank portion 224. In an embodiment, a length of the second shank portion 224 may be larger than a height defined by second portion 202 of the groove 174. In such a case, the second shank portion 224 may extend beyond the top surface 172 and outwardly of the groove 174, and may act as a handle to facilitate a holding of the punch 220 for performing the staking of the pin 130.

Referring to FIG. 9 to 15, a staking tool assembly 150' is disclosed according to an alternate embodiment of the present disclosure. Similar to the staking tool assembly 150, the staking tool assembly 150' also includes a guide block 160' having a top surface 172', a bottom surface 170', a first axial end 176', a second axial end 178', a first longitudinal end 184', a second longitudinal end 186', a body portion 162' having a first longitudinal surface 180' and a second longitudinal surface 182', a first leg portion 164' having a first extended portion 190', a second leg portion 166' having a second extended portion 192'. The guide block 160' further includes a groove 250 (hereinafter referred to as first groove 250) and a second groove 252. A formation and arrangement of the first groove 250 and the second groove 252 differentiates the guide block 160' from the guide block 160, but apart from the arrangement and the formations of first groove 250 and the second groove 252, the guide block 160' remains largely similar to the guide block 160 of the staking tool assembly 150.

Figure 12:
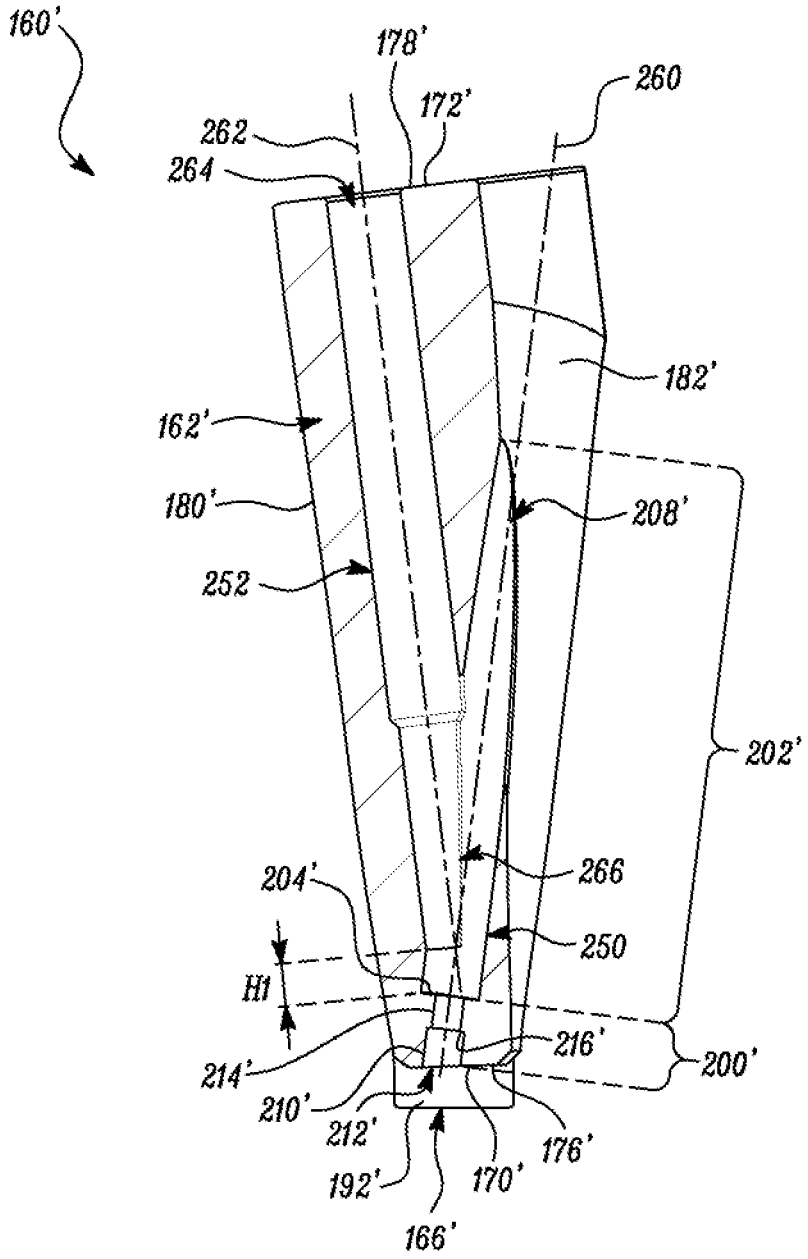
FIG. 12 is a sectional front view of the guide block of FIG. 9 depicting the first groove and the second groove at an inclination to the first groove, in accordance with an embodiment of the present disclosure.
Figure 15:
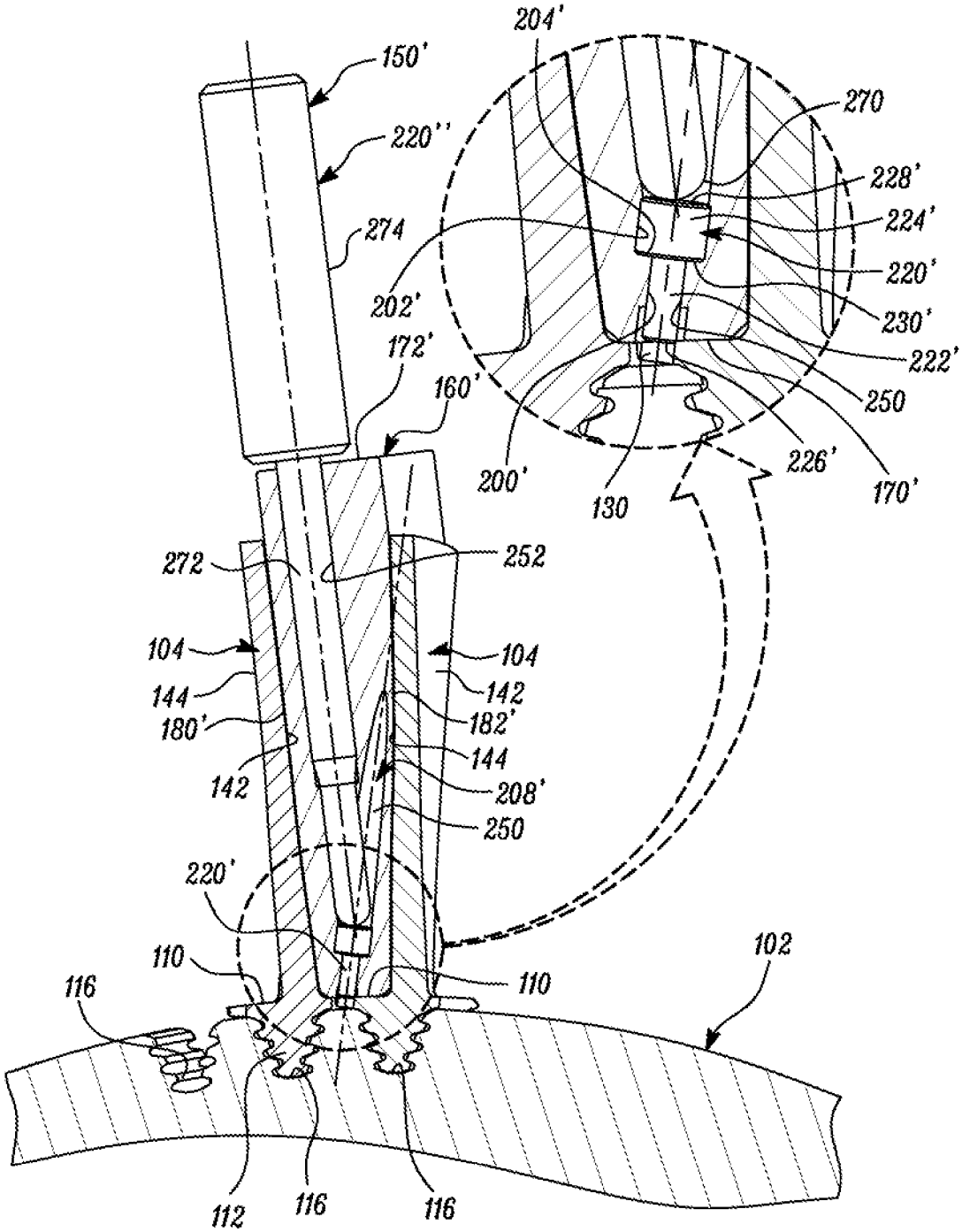
FIG. 15 is a sectional view of the staking tool assembly of FIG. 9 having the guide block disposed between the space defined between consecutive turbine blades, and depicting the first punch disposed inside the first groove and the second punch inserted inside the second groove and abutting the first punch, in accordance with an embodiment of the present disclosure.

As shown in FIG. 12 and FIG. 15, the first groove 250 extends from the bottom surface 170' of the guide block 160' to the second longitudinal surface 182' (or, alternatively, to the first longitudinal surface 180'), and is configured to receive the pin 130 extending outwardly from the blade root 106 to facilitate the staking of the pin 130. The first groove 250 extends from the bottom surface 170' through the body portion 162' to the top surface 172'. The first groove 250 includes a first portion 200' and a second portion 202'. The first portion 200' extends from the bottom surface 170' into the body portion 162' towards the second longitudinal surface 182', and is configured to receive the portion of the pin 130. The second portion 202' extends from the first portion 200' away from bottom surface 170', and defines a step 204' at an interface of the first portion 200' with the second portion 202'. As shown in FIG. 12 and FIG. 15, the second portion 202' extends from the first portion 200' to the second longitudinal surface 182', and defines an opening 208' at the second longitudinal surface 182'.

Further, the first portion 200' includes a lower portion 210' that extends from the bottom surface 170' into the body portion 162', and is configured to receive the portion of the pin 130. The lower portion 210' defines an opening 212' at the bottom surface 170' to facilitates an entry of the pin 130 into the first groove 250. The first portion 200' also includes an upper portion 214' that extends from the lower portion 210' away from the bottom surface 170' to the second portion 202'. In an embodiment, both the upper portion 214' and the lower portion 210' include cylindrical profiles, and includes a first diameter and a second diameter respectively. The diameter of the upper portion 214' i.e., the first diameter is smaller than the diameter of the lower portion 210' i.e., the second diameter. Owing to a smaller diameter of the upper portion 214' relative to the diameter of the lower portion 210', a step 216' is defined at the interface of the lower portion 210' with the upper portion 214'. The step 216' is configured to restrict a movement of the pin 130 into the upper portion 214' of the first groove 250.

Further, in an embodiment, the second portion 202' of the first groove 250 may also include a cylindrical profile having a third diameter. As shown, a diameter of the second portion 202' i.e., the third diameter is larger than the diameter of the upper portion 214' i.e., the first diameter and the diameter of the lower portion 210' i.e., the second diameter. In an embodiment, each of the lower portion 210', the upper portion 214', and the second portion 202' define a constant cross-sectional area throughout corresponding extensions. The step 204' is defined/formed at the interface of the second portion 202' with the upper portion 214' of the first portion 200' due to a relatively larger diameter of the second portion 202' relative to the diameter of the upper portion 214' of the first portion 200'. The second portion 202', the upper portion 214', and the lower portion 210' may be co-axial to each other, and may together define a common axis, referred to as a first axis 260 of the first groove 250. Further, the opening 208' defined at the second longitudinal surface 182' of the guide block 160' facilitate an entry of a punch 220' (hereinafter referred to as first punch 220' and described later) into the first groove 250 of the staking tool assembly 150' for facilitating the staking of the pin 130.

Further, the second groove 252 extends from the top surface 172' to the first groove 250, and defines a second axis 262 tilted at an angle relative to the first axis 260. As shown in FIG. 12 and FIG. 15, the second axis 262 is tilted at an acute angle relative to the first axis 260. The second groove 252 defines an opening 264 at the top surface 172' to facilitate an entry of a second punch 220" of the staking tool assembly 150' for delivering a blow to the first punch 220' and facilitating the staking of the pin 130. In an embodiment, the second groove 252 extends from the top surface 172' at an inclination to the first groove 250, and meets the second portion 202' of the first groove 250. In an embodiment, the second groove 252 meets the first groove 250 at a height 'H1' above the step 204'. The height 'H1' is selected to ensure that the second punch 220" may suitably strike the first punch 220' for staking the pin 130. In an embodiment, the height 'H1 is selected such that an opening 266 of the second groove 252 defined/formed at an interface of the first groove 250 and the second groove 252 remains at least partly clear of the first punch 220' to ensure proper striking of the first punch 220' by the second punch 220". In an embodiment, the height 'H1' also depends on a length of the first punch 220'.

The staking tool assembly 150' includes the first punch 220' and the second punch 220" to perform the staking of the pin 130. As shown in FIG. 15, the first punch 220' is inserted and extended into the first groove 250 through the opening 208', and abuts the pin 130 to facilitates the staking of the pin 130, while the second punch 220" is inserted into the second groove 252 through the opening 264, and may extend partially into the first groove 250 to strike the first punch 220' to perform staking of the pin 130.

Figure 13:
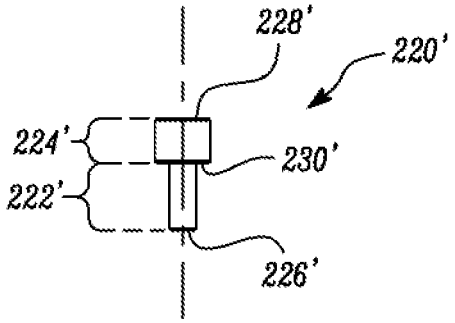
FIG. 13 is a front view of a first punch of the staking tool assembly of FIG. 9, in accordance with an embodiment of the present disclosure.

Referring to FIG. 13 and FIG. 15, the first punch 220' includes a first shank portion 222' and a second shank portion 224', a first end 226', and a second end 228'. The first shank portion 222' is configured to strike the portion of the pin 130 received within the lower portion 210' of the first portion 200' of the first groove 250, during operation, to perform the staking of the pin 130. The first shank portion 222' extends from the first end 226' to the second shank portion 224'. A profile of the first shank portion 222' may be complementary to a profile of the upper portion 214' of the first portion 200' of the first groove 250. In an embodiment, the first shank portion 222' may include a cylindrical profile, and may include a first diameter. The first shank portion 222' is configured to be slidably received within the first portion 200' of the first groove 250 to facilitate the staking of the pin 130. Further, in an embodiment, a diameter of the first shank portion 222' i.e. the first diameter may be such that an outer surface of the first shank portion 222' may abut an inner surface of the upper portion 214' of the first portion 200' of the first groove 250.

In an embodiment, a length of the first shank portion 222' may be equal to a height of the first portion 200' of the first groove 250. This prevents a movement of the first punch 220' beyond the bottom surface 170' during the staking of the pin 130. Further, the length of the first shank portion 222' may be greater than a height defined by the upper portion 214' of the first portion 200' of the first groove 250. This enables the first shank portion 222' to move beyond the upper portion 214' along a direction of insertion of the first punch 220', and to extend at least partly into the lower portion 210' of the first portion 200' of the first groove 250. Such movement and extension facilitate the first shank portion 222' to abut and strike the pin 130 received into the lower portion 210' of the first portion 200' of the first groove 250 for performing staking of the pin 130. The movement and the extension of the first shank portion 222' into the lower portion 210' of the first portion 200' of the first groove 250 may be restricted by the step 204'.

The second shank portion 224' extends longitudinally away from the first shank portion 222' to the second end 228', and a profile of the second shank portion 224' may be complementary to a profile of the second portion 202' of the first groove 250. In this manner, the second shank portion 224' may be configured to abut the step 204' to restrict a movement of the first punch 220' towards the bottom surface 170'. To this end, the second shank portion 224' defines a stopper 230' at an interface of the second shank portion 224' with the first shank portion 222'. The stopper 230' is configured to abut the step 204' to restrict an axial movement of the first punch 220' within the first groove 250 towards the bottom surface 170'. In an embodiment, the second shank portion 224' may include a cylindrical profile having a second diameter. In an embodiment, the diameter of the second shank portion 224' i.e., the second diameter is larger than the diameter of the first shank portion 222' i.e., the first diameter. In such a case, the stopper 230' is defined/formed at the interface of the second shank portion 224' with the first shank portion 222' due to a larger diameter of the second shank portion 224' relative to the diameter of the first shank portion 222'. In an embodiment, the length of the first punch 220' may be selected such that the first punch 220' remains, at least partly, clear of the opening 266, when inserted inside the first groove 250, to enable a striking of the first punch 220' by the second punch 220".

Figure 14:
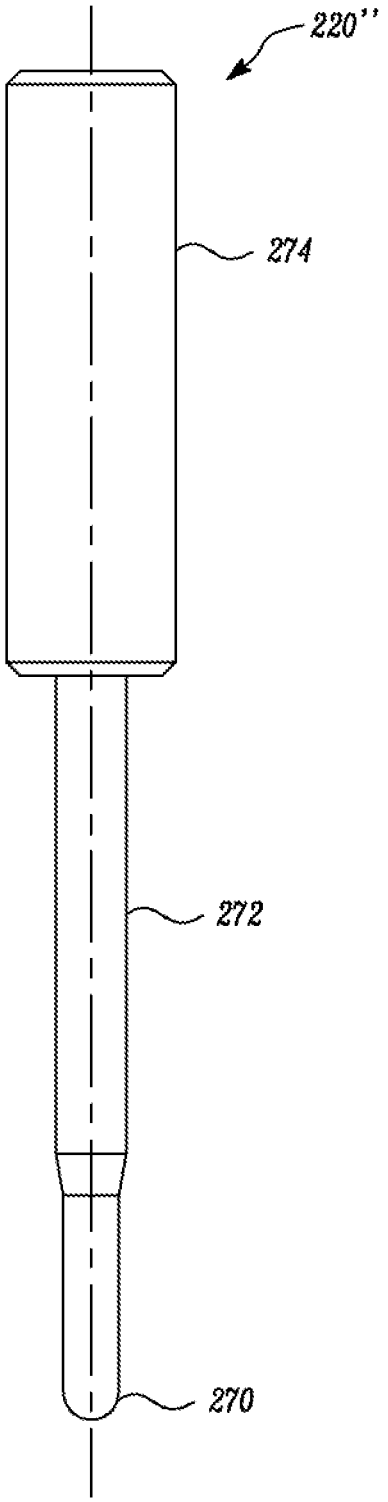
FIG. 14 is a front view of the second punch of the staking tool assembly of FIG. 9, in accordance with an embodiment of the present disclosure.

Referring to FIG. 14 and FIG. 15, the second punch 220" may comply with a dimension of the second groove 252, and may include an end 270. The second punch 220" is configured to extend partly within the first groove 250 through the second groove 252, and is configured to strike the second shank portion 224' of the first punch 220' to facilitate staking of the pin 130. The second punch 220" may be configured to be inserted through the opening 264 of the second groove 252 such that, during an operation of the staking tool assembly 150', the end 270 of the second punch 220" may be able to abut and strike the second shank portion 224' of the first punch 220'. In one example, the end 270 may include a convex shape, formed in the manner of a semi-spherical structure, so that the end 270 may define a point of contact with the second shank portion 224' of the first punch 220'. In an embodiment, the first axis 260 and the second axis 262 may intersect each other at this point of contact. By such an arrangement, an impact provided by the second punch 220" may be effectively transferred to the first punch 220', and in turn, to the portion of the pin 130 that may be received within the lower portion 210' of the first groove 250. In other embodiments, the end 270 may include various other shapes, such as a flat planer shape, oblong shape, frusto-conical shape, and similar such shapes.

In an embodiment, the second punch 220" includes a shaft portion 272 and a handle 274 extending longitudinally from the shaft portion 272. The shaft portion 272 includes the end 270, and is configured to be slidably received into the second groove 252 and also partially extend into the first groove 250. The handle 274 is configured to be disposed outwardly of the second groove 252, and is configured to be held by an operator to perform the staking of the pin 130. In an embodiment, the handle 274 is configured to abut the top surface 172' of the guide block 160' to restrict a movement of the second punch 220" towards the first punch 220' within the second groove 252. In certain implementations, the handle 274 may include a cylindrical profile, and may include a diameter larger than the diameter of the shaft portion 272. In an embodiment, a length of the shaft portion 272 may be larger than a height defined by second groove 252. In such a case, the shaft portion 272 may extend beyond the top surface 172' and outwardly of the second groove 252, and may act as a handle to facilitate a holding of the second punch 220" for performing the staking of the pin 130.

INDUSTRIAL APPLICABILITY

For mounting the turbine blade 104 to the turbine disk 102, the root structure 112 of the turbine blade 104 may be inserted into the cutout 116 from one of the first axial end 146 of the turbine disk 102 or the second axial end 148 of the turbine disk 102, and the platform 110 may be rested atop the turbine disk posts 118 of the turbine disk 102 such that the hole 126 on the platform 110 align with the slot 120 of the turbine disk post 118. Thereafter, an operator may insert the pin 130 through the hole 126 provided on the platform 110, and may drive the pin 130 into the slot 120 so that the turbine blade 104 may be engaged with the turbine disk 102. In such a state, a portion of the pin 130 extends outwardly of the platform 110. To ensure that the pin 130 remains positively coupled to the turbine disk 102 and the turbine blade 104, the staking of the pin 130 is performed. Staking is defined as a process for deforming the portion of the pin 130 such that a diameter of the pin 130 disposed inside the slot 120 becomes larger than a diameter of the hole 126. To perform the staking of the pin 130, the staking tool assembly 150, 150' are used.

For performing the staking by use of the staking tool assembly 150, an operator may first position the guide block 160 in between the space 152 defined between two consecutive turbine blades 104. The placement is such that the first longitudinal surface 180, with the first profile, complements and is seated against the pressure side 142 of the turbine blade 104, while the second longitudinal surface 182 complements and is seated against the suction side 144 of consecutive turbine blade 104. Further, the first extended portion 190 of the first leg portion 164 abuts the first axial end 146 of the turbine disk 102, while the second extended portion 192 of the second leg portion 166 abuts the second axial end 148 of the turbine disk 102. This ensures an alignment of the groove 174 of the guide block 160 with the hole 126 of the turbine blade 104, thereby enabling an insertion of the portion of the pin 130 into the lower portion 210 of the first portion 200 of the groove 174. In the installed state of the guide block 160, the bottom surface 170 abuts the platform 110. Thereafter, the punch 220 is inserted into the groove 174 through the opening 208 such that the first shank portion 222 may contact or abut the portion of the pin 130 received into the first portion 200 of the groove 174. At this state, the second shank portion 224 (or the stopper 230) may define a gap with the step 204. The operator may then use the handle 232 to reciprocate the punch 220 inside the groove 174 to deliver one or more blows and strikes against the portion of the pin 130. In so doing, the portion of the pin 130 disposed inside the slot 120 may be deformed. The operator may continue to deliver the blow till the second shank portion 224 comes into abutment with the step 204 formed in the groove 174. At this stage, the force from the punch 220 to the pin 130 is no longer transferred, preventing an excessive deformation of the pin 130. Further, at this stage, the staking of the pin 130 is completed.

For staking the pin 130 by use of the staking tool assembly 150', an operator may first insert the first punch 220' into the first groove 250 through the opening 208'. The first punch 220' may be disposed inside the first groove 250 such that the first shank portion 222' may be disposed inside the first portion 200' of the first groove 250, and the second shank portion 224' may be disposed inside the second portion 202' of the first groove 250 such that the stopper 230' abuts the step 204'. Thereafter, the operator may first position the guide block 160' in between the space 152 defined between two consecutive turbine blades 104. The placement is such that the first longitudinal surface 180', with the first profile, complements and is seated against the pressure side 142 of the turbine blade 104, while the second longitudinal surface 182' complements and is seated against the suction side 144 of consecutive turbine blade 104. Further, the first extended portion 190' of the first leg portion 164' abuts the first axial end 146 of the turbine disk 102, while the second extended portion 192' of the second leg portion 166' abuts the second axial end 148 of the turbine disk 102. This ensures an alignment of the first groove 250 (first portion 200') of the guide block 160' with the hole 126 of the turbine blade 104, thereby enabling an insertion of the portion of the pin 130 into the lower portion 210' of the first portion 200' of the first groove 250. In the installed state of the guide block 160', the bottom surface 170' abuts the platform 110. As the pin 130 moves inside the lower portion 210' of the first groove 250, the first punch 220' may be lifted owing to the abutment with the pin 130. At this state, the second shank portion 224' (i.e. stopper 230') defines a gap with the step 204' formed in the first groove 250.

Thereafter, to perform the staking of the pin 130, the operator may insert the second punch 220" into the second groove 252 through the opening 264 such that the end 270 of the second punch 220" abuts against the second shank portion 224' of the first punch 220'. The operator may then use the handle 274 to reciprocate the second punch 220" inside the second groove 252 and the first groove 250 to deliver one or more blows and strikes against the first punch 220'. The first punch 220' in turn translates the impact of the strike and transfers the force to the pin 130. In so doing, the portion of the pin 130 disposed inside the slot 120 may be deformed. The operator may continue to deliver the blow till the second shank portion 224' comes into abutment with the step 204' formed in the first groove 250. At this stage, the force from the first punch 220' to the pin 130 is no longer transferred, preventing an excessive deformation of the pin 130. Further, at this stage, the staking of the pin 130 is completed.

What is claimed is:

1. A staking tool assembly for staking a pin coupling a turbine blade with a turbine disk, the staking tool assembly comprising:

a guide block configured to be positioned between a space defined between two consecutive turbine blades mounted on the turbine disk, the guide block including a bottom surface configured to abut a blade root of the turbine blade, and a groove extending from the bottom surface through the guide block and configured to receive a portion of the pin extending outwardly from the blade root to facilitate a staking of the pin.

2. The staking tool assembly of claim 1, wherein the guide block includes a first leg portion disposed at a first longitudinal end of the guide block and configured to abut a first axial end of the turbine disk, and a second leg portion disposed at a second longitudinal end of the guide block and configured to abut a second axial end of the turbine disk.

3. The staking tool assembly of claim 1, wherein the guide block further includes a body portion including a first longitudinal surface having a first profile complimentary to a pressure side of the turbine blade, and a second longitudinal surface disposed opposite to the first longitudinal surface, the second longitudinal surface having a second profile complimentary to a suction side of the turbine blade.

4. The staking tool assembly of claim 1, wherein the groove includes a first portion extending from the bottom surface and is configured to receive the portion of the pin, and a second portion extending from the first portion away from the bottom surface and defining a step at an interface of the first portion with the second portion.

5. The staking tool assembly of claim 4, wherein the first portion includes a lower portion extending from the bottom surface to receive the portion of the pin, and an upper portion extending from the lower portion to the second portion, wherein a diameter of the upper portion is smaller than a diameter of the lower portion.

6. The staking tool assembly of claim 4, wherein the guide block further includes a top surface disposed opposite to the bottom surface, the second portion extends from the first portion to the top surface.

7. The staking tool assembly of claim 6 further including a punch configured to extend inside the groove, the punch including a first shank portion configured to strike the pin to perform the staking of the pin, and a second shank portion extending longitudinally from the first shank portion, and configured to abut the step to restrict an axial movement of the punch towards the bottom surface.

8. The staking tool assembly of claim 7, wherein the punch further includes a handle extending longitudinally from the second shank portion away from the first shank portion, the handle configured to extend outwardly to the groove to be held by an operator to perform staking of the pin.

9. The staking tool assembly of claim 4, wherein the guide block further includes a top surface disposed opposite to the bottom surface, and a longitudinal surface disposed between the top surface and the bottom surface, wherein the second portion extends from the first portion to the longitudinal surface.

10. The staking tool assembly of claim 9, wherein the groove is a first groove having a first axis, the guide block further includes a second groove extending from the top surface to the first groove and having a second axis, the second axis is tilted relative to the first axis.

11. The staking tool assembly of claim 10 further including a punch configured to extend inside the first groove, the punch including a first shank portion configured to strike the pin to perform the staking of the pin, and a second shank portion extending longitudinally from the first shank portion, and configured to abut the step to restrict an axial movement of the punch towards the bottom surface.

12. The staking tool assembly of claim 11, wherein the punch is a first punch, the staking tool assembly further including a second punch configured to extend partly within the first groove through the second groove and is configured to strike the second shank portion to facilitate staking of the pin.

13. The staking tool assembly of claim 12, wherein the second punch includes an end to strike the first punch, the end including a convex shape.

14. The staking tool assembly of claim 12, wherein the second punch further includes a handle configured to be disposed outwardly to the second groove to be held by an operator to perform staking of the pin.

* * * * *